United States Patent [19]

Safranek

[11] Patent Number: 4,901,704

[45] Date of Patent: Feb. 20, 1990

[54] HALL EFFECT DEVICE IGNITION AND CHARGING SYSTEM

[75] Inventor: Edward J. Safranek, Arlington Heights, Ill.

[73] Assignee: F & B Mfg. Co., Gurnee, Ill.

[21] Appl. No.: 191,876

[22] Filed: May 9, 1988

[51] Int. Cl.[4] ..... F02P 3/06

[52] U.S. Cl. ..... 123/599; 123/149 D; 123/617

[58] Field of Search ..... 123/149 A, 149 D, 599, 123/602, 617, 414, 146.5 A

[56] References Cited

U.S. PATENT DOCUMENTS

| | | | |
|---|---|---|---|
| 3,297,009 | 1/1967 | Sasaki et al. | 123/414 |
| 3,623,647 | 11/1971 | Piteo | 123/149 D |
| 3,741,185 | 6/1973 | Swift et al. | 123/149 D |
| 3,961,618 | 6/1976 | Swift | 123/149 D |
| 4,008,701 | 2/1977 | Webber | 123/617 |
| 4,146,831 | 3/1979 | Farr | 322/94 |
| 4,155,340 | 5/1979 | Fernquist et al. | 123/602 |
| 4,155,341 | 5/1979 | Fernquist et al. | 123/602 |
| 4,160,435 | 7/1979 | Sleder | 123/149 D X |
| 4,235,213 | 11/1980 | Jellissen | 123/617 X |
| 4,275,703 | 6/1981 | Bodig et al. | 123/617 |
| 4,428,332 | 1/1984 | Brammer | 123/617 X |
| 4,458,195 | 7/1984 | Piteo | 322/94 |
| 4,791,365 | 12/1988 | Johannes et al. | 123/617 X |

OTHER PUBLICATIONS

"Specifier's Guide for Solid State Sensors", 1984, Catalog 20, Issue 7, Micro Switch, a Honeywell Division, pp. 2, 3, 9, 16, 25, and 76.

Japanese Book, pp. 226–271 (untranslated); no date.

*Primary Examiner*—Tony M. Argenbright

*Attorney, Agent, or Firm*—Hill, Van Santen, Steadman & Simpson

[57] ABSTRACT

An engine ignition and charging system employs magnets mounted on a rotor, and a stator positioned relative to the rotor such that charge coils, alternator coils, and a power coil on the stator are located such that the magnets pass in close proximity thereto as the rotor rotates. The rotor also has a magnetic timing means for generating a timing flux path at a predetermined location relative to the rotor. A Hall effect transducer circuit is positioned in proximity to the rotor such that as the flux path passes, the flux path is sensed so as to generate a timing trigger voltage. This trigger voltage is employed in conjunction with an ignition voltage generating circuit to supply an ignition voltage to a spark plug in timed sequence with rotation of the rotor. The power coil on the stator supplies power to the Hall effect transducer for operation thereof. A charging circuit connects an output of the alternator coils to a system battery for charging thereof. With the disclosed system, timing pulses are provided which are substantially independent of engine RPM.

29 Claims, 7 Drawing Sheets

HALL EFFECT DEVICE IGNITION AND CHARGING SYSTEM

RELATED APPLICATIONS

Co-pending applications of the same inventor, also relating to ignition and charging systems are: "High Efficiency Charging and Regulating System", Ser. No. 191,877 filed May 9, 1988 "High Efficiency Electrical Generator System", Ser. No. 191,875 filed May 9, 1988 and "Improved Stator Assembly and Method for Manufacture Thereof", Ser. No. 191,878 filed May 9, 1988.

BACKGROUND OF THE INVENTION

1. Field of the Invention:

The present invention relates to engine ignition and charging systems, such as for gasoline engines employing spark plugs. More particularly, the present invention relates to marine engine ignition and charging systems.

2. Description of the Prior Art:

It is known in small engine ignition systems to provide trigger coils which sense passage of a magnet or magnetic flux and which generate a trigger signal. A magnetic flux path may be generated by a ring magnet and associated flux concentrator plates, the flux path being sensed by the trigger coils. The trigger signals may be employed to produce ignition pulses, such as by a capacitive discharge ignition circuit controlled by the trigger signals. Exemplary of such systems are U.S. Pat. Nos. 3,741,185 and 3,961,618 and certain prior art alternators such as by the Suzuki Corp.

With such prior art systems, the trigger pulses from the pickup or trigger coils are dependent on RPM. At low RPM, slow flux changes result in weak output pulses from the trigger or pickup coils. Furthermore, at low RPM, the shape of the trigger pulses is different than at higher RPMs. The change in amplitude and shape of the trigger pulses causes various problems in such prior art ignition systems. For example, at low RPM, the engine may not start due to insufficient trigger signal amplitude or improper wave shape. Furthermore, the ignition timing changes from low to high RPM in view of the pulse amplitude and shape variations. Thus, complicated circuitry is required to take into account the changing ignition timing with variations in speed. Also, with such prior art systems, ignition timing adjustments can be complicated and cannot be optimized.

It has also been known in prior art systems such as in the Chrysler Hall effect device gasoline engine distributor shown at page 76 of the Micro Switch, Honeywell Division Catalog No. 20, issue 7, 1984, to provide a single Hall effect device having a construction such as shown at page 25 of the Micro Switch catalog, wherein such a device is mounted alongside a rotating distributor shaft and wherein a ferrous metal vane-interrupter as part of the rotor assembly is provided. The individual vanes, pass through a gap between a magnet and a Hall effect sensor so as to switch the Hall effect sensor on and off. In such a system, power for the Hall effect device is supplied directly from a battery associated with the gasoline engine.

The above described Hall effect device triggers the ignition module in a fashion analogous to a breaker type ("points") Kettering ignition system. Thus, the Hall effect device with its associated circuitry is a substitute for the points and forms a breakerless conductive ignition system.

With such a prior art system, the Hall effect devices require the vehicle battery for power, and the battery must be disconnected from the Hall effect devices and associated circuitry when the engine is not running. Furthermore, in such a prior art system a distributor, rotor, and distributor cap is required. Furthermore, since only one Hall effect device is used for all cylinders, if a defect occurs, timing to all cylinders is affected adversely so that ignition to all cylinders is affected.

It has also been known, such as shown at page 76 of the Micro Switch catalog, to provide a ring magnet with alternating poles for alternating on/off actuation of a Hall effect device.

An additional problem of prior art systems is the creation of radio frequency interference (RFI).

A further problem in prior art ignition and/or charging systems is a continuing battery drain, though perhaps small, even when the engine is not running. Such prior art systems thus required a battery disconnect switch.

SUMMARY OF THE INVENTION

It is an object of the present invention to substantially eliminate dependence of ignition timing on engine RPM.

It is a further object of the invention to provide a more efficient ignition system such that engines, and particularly marine engines, will start more efficiently and reliably at low RPM, and which will have improved ignition timing given RPM variations.

It is another object of the invention to provide an ignition system which does not employ a distributor, a rotor, a distributor cap, and does not rely on a battery.

It is another object of the invention to provide an ignition system wherein each cylinder has its own timing device associated therewith together with its own control circuitry and ignition coil.

It is a further object of the invention to provide an improved ignition and charging system in which timing can be set more accurately, and can be maintained indefinitely without readjustment.

It is a further object of the invention to prevent all battery drain by the ignition and/or charging system when the engine is not running, and an ignition switch for disconnecting the battery from the ignition and/or charging system is not required.

According to the present invention, an ignition and charging system is provided wherein a Hall effect transducer is provided to initiate ignition triggering or timing pulses. Preferably a flux concentration system is employed in conjunction with the Hall effect transducer so as to provide triggering pulses at low RPM and wherein such triggering pulses are substantially independent of RPM with respect to amplitude and wave shape. A separate power coil is provided for operating the Hall effect transducer independently of alternator coils on the stator assembly.

DESCRIPTION OF THE PREFERRED EMBODIMENTS

Figure 1:
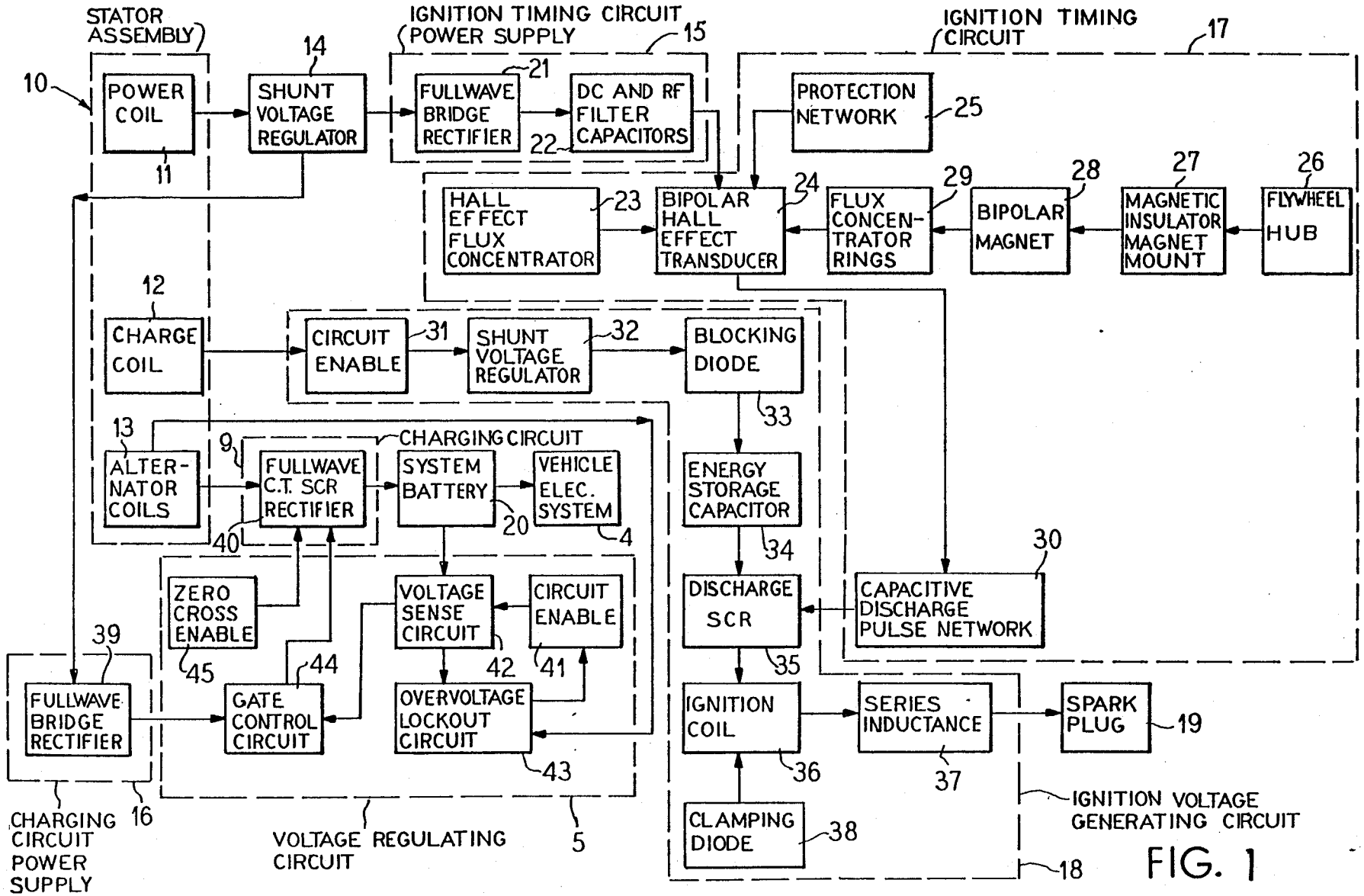
FIG. 1 is a block diagram of the Hall effect device ignition and charging system of the invention.

The block diagram of FIG. 1 generally shows the overall Hall effect device ignition and charging system of the present invention. The schematically illustrated stator assembly 10 has a power coil 11, charge coil 12, and alternator coils 13. The actual mechanical structure of the stator assembly 10 is shown in greater detail in the cross-sectional view of FIG. 2 and the top view of FIG. 3. The remainder of the circuit blocks shown in FIG. 1 are illustrated in greater detail in the detailed schematic diagram shown in FIGS. 4A, 4B, and 5, to be discussed hereafter.

The main circuit blocks of the Hall effect device ignition and charging system of the invention shown in FIG. 1 are as follows. Voltage from the power coil 11 is supplied via an ignition timing circuit power supply 15 to power the ignition timing circuit 17. Voltage from the power coil 11 is also fed via a charging circuit power supply 16 to the voltage regulating circuit 5.

The charge coil 12 of the stator assembly 10 provides voltage to the ignition voltage generating circuit 18 which in turn generates a high voltage for generating spark at the spark plug 19.

The alternator coils 13 provide supply voltage via a charging circuit 9 to the system battery 20 and to the vehicle electrical system 4 connected in parallel thereto. The voltage regulating circuit 5 controls operation of the charging circuit 9 so as to control voltage fed to the system battery 20. Of course, the system battery 20 also connects to the marine or automotive on-board electronics system to be powered, such as lighting, radios, heaters, and other accessories (not shown).

Referring now to FIG. 1 in greater detail, the power coil 11 feeds a shunt voltage regulator 14 which controls voltage output to both the ignition timing circuit power supply 15 and the charging circuit power supply 16.

The ignition timing circuit power supply 15 contains a full wave bridge rectifier 21 which outputs to DC and RF filter capacitors 22. The filter capacitors output power supply voltage to the bipolar Hall effect transducer 24 in an ignition timing circuit 17. Additionally a protection network 25 prevents damage to the bipolar Hall effect transducer 24 during system operation.

On the flywheel hub 26 a bipolar ceramic magnet 28 is mounted by a magnetic insulator magnet mount 27. Flux concentrator rings 29 concentrate the magnetic flux so as to precisely effect turn on and turn off of the bipolar Hall effect transducer in conjunction with the Hall effect flux concentrator 23 as described hereafter in reference to FIGS. 2 and 3.

Figure 3A:
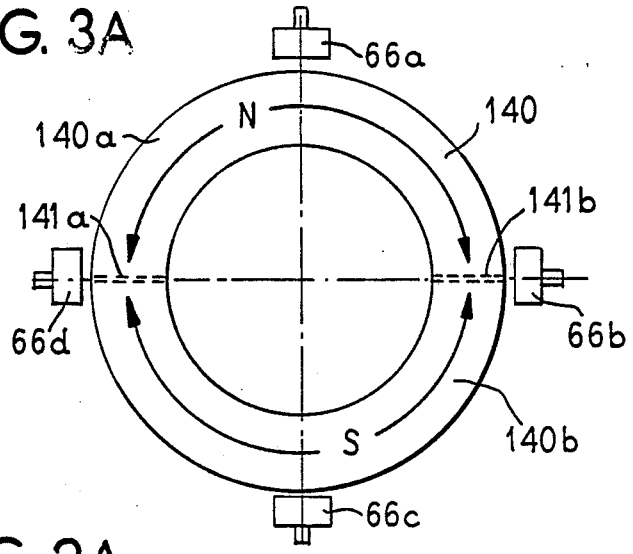
FIG. 3A is an alternate embodiment of a trigger magnet assembly employed in FIG. 3.
Figure 3:
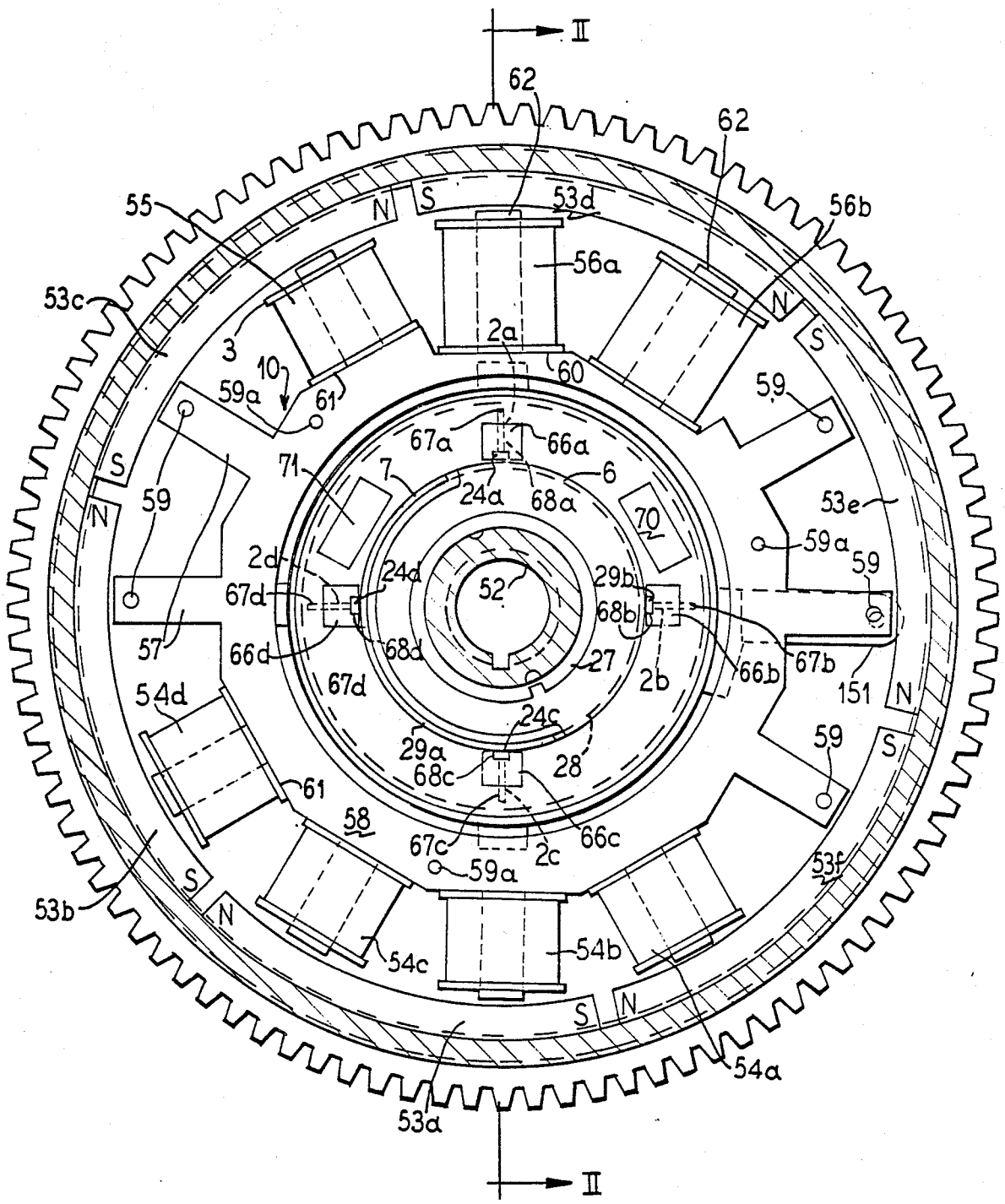
FIG. 3 is a top sectional view of the flywheel assembly, stator assembly, and ignition timing housing containing the Hall effect device in the ignition and charging system of the invention.

In an alternate embodiment of a portion of the system shown in FIG. 3, the bipolar magnet 28, magnetic insulator magnet mount 27, and flux concentrator rings 29 are eliminated and replaced with a plastic bonded ferrite molded magnet 140 shown in FIG. 3A. Such a magnet has a hemispherical north pole portion 140*a* and a hemispherical south pole portion 140*b* which converge with one another at first and second neutral sections 141*a* and 141*b*. The neutral sections must be as small as possible so that a sharp transition occurs between the north and south poles as the magnet rotates. It is preferred that the neutral sections have a width no greater than 0.045, and preferably having a maximum width of 0.03 inches with a design center of preferably 0.025 inches.

A switching signal from the bipolar Hall effect transducer 24 is fed to a capacitor discharge pulse network 30 so as to control the discharge SCR 35. Power is fed to the discharge SCR from the charge coil 12, through the circuit enable 31, shunt voltage regulator 32, blocking diode 33, and energy storage capacitor 34. The discharge SCR 35 then provides voltage to the ignition coil 36 in accordance with the desired timing of the ignition system so as to create a high voltage output to a series inductance 37 which in turn delivers a high voltage to a spark plug 19 for engine ignition. A clamping diode 38 also controls operation of the ignition coil 36.

The alternator coils 13 supply a charging voltage to the system battery 20 through full wave SCR rectifier 40. Additionally, the alternator coils supply voltage to the overvoltage lockout circuit 43. Circuit 43 outputs to circuit enable 41 which controls the voltage sense circuit 42 which also receives system battery voltage from battery 20. The over-voltage lockout circuit 43 is controlled by a separate over-voltage sense circuit 43*a*.

An output of the voltage sense circuit 42 connects to a gate control circuit 44 which in turn controls the full wave SCR rectifier 40. A zero cross enable circuit 45 also controls SCR rectifier 40. A full wave bridge rectifier 39 provides operating voltage to the gate control circuit 44.

Figure 2:
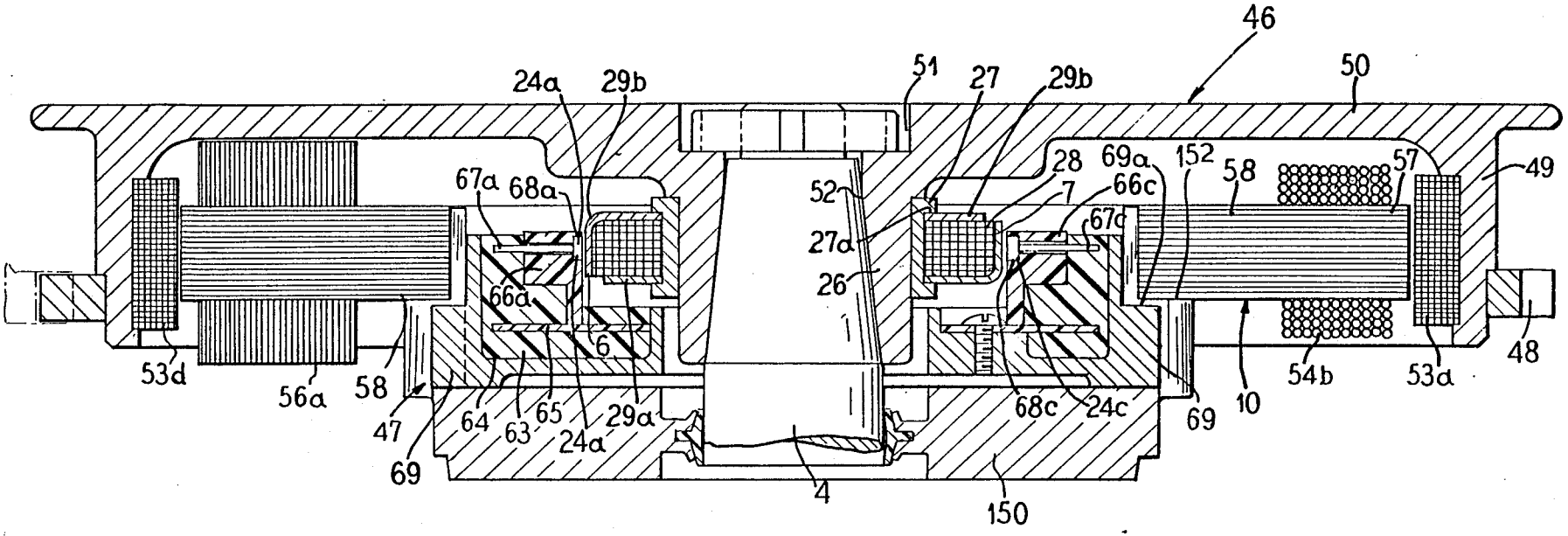
FIG. 2 is a cross-sectional view of the flywheel, stator assembly, and Hall effect device portions of the improved ignition and charging system of the invention, and represents a cross-sectional view taken along the lines II—II of FIG. 3.

Referring now to FIGS. 2 and 3, the mechanical relationship of the flywheel or rotor 46, stator assembly 10, and ignition timing housing 47 containing the Hall effect transducers 24*a, b, c, d* will now be described in greater detail. FIG. 2 is a cross-sectional view taken along line II—II of FIG. 3 illustrating the top view.

As shown most clearly in FIG. 2, the flywheel or rotor 46 rotates in accordance with the drive shaft 4 of the engine not shown here. Such a drive shaft would mount in aperture 52 and be secured at mounting aperture 51. A starting ring gear 48 is attached at a peripheral portion of outer circular wall 49 of the flywheel or rotor 46. Ring gear 48 may be employed for starting of the engine through engagement with a starter motor. Alternatively, in a marine engine the flywheel or rotor 46 may be rotated during starting by a manual pull cord, not shown.

Flywheel 46 includes an upper wall 50 and a flywheel central hub portion 26 at which the mounting apertures 51 and 52 are provided at the inside of the hub 26.

A plurality of north-south ceramic magnets 53*a, b, c, d, e, f* are provided on an inner surface of the circular wall 49 in a circular pattern as shown most clearly in the top view of FIG. 3. Adjacent end faces of the magnets alternate in polarity around the circle on which the magnets lie.

The stator assembly 10 is formed of a plurality of stacked laminations 58 shaped as shown in FIG. 3. Individual pole legs 57 and 62 are provided. The pole legs 57 are shorter and receive the power coil 55 or alternator coils 54*a, b, c, d*. Relatively longer pole legs 62 are provided for receiving charge coils 56*a, b*. The relatively longer pole legs 62 extend from a smaller radius surface 60 and the relatively shorter pole legs 57 extend from a larger radius surface 61 of the laminations.

Shorter legs can also be used for the charge coils, but increased copper mass on longer legs keeps the charge coils running cooler.

The laminations are held together by interior rivets 59*a* and also rivets 59 passing through ends of the unused pole legs to prevent vibration caused by the magnetic field. By use of the rivets 59, it is not necessary to impregnate the laminations.

The ignition timing housing 47 rests on a bearing cage 150 containing bearings for the motor crank shaft 4. The bearing cage 150 is an integral part of the engine. The laminations are supported on a cut-out step or shoulder 152. Four of such shoulders 152 may be provided.

The housing 47 may be rotatably positioned relative to the bearing cage 150 through fixing arm 151 (shown in FIG. 3) which extends from the housing 47. This fixing arm 151 may be secured in place after a desired timing has been achieved. By rotating the housing 47, the Hall effect devices are positioned relative to the magnetic timing means to achieve a desired timing relationship.

The housing 47 also has bosses or stop portions 69 having an upper surface 69*a* which serves to limit movement of the housing 47 in an axial direction of shaft 4 through abutment with a lower edge of the laminations 58.

The housing 47 retains the trigger or timing circuit PC board 65 impregnated in a pocket 64 therein.

Figure 2A:
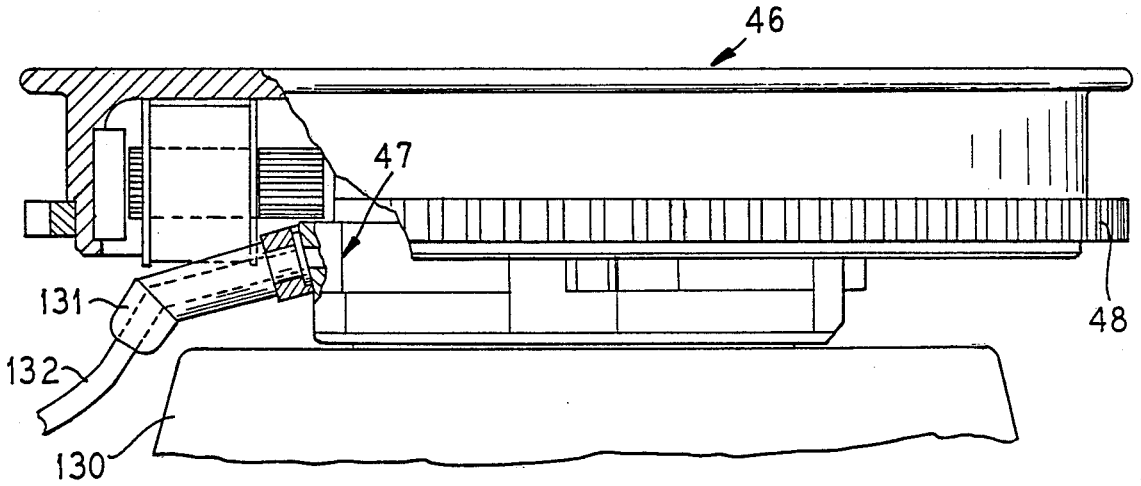
FIG. 2A is a side view of a trigger assembly with Hall effect devices in relation to the flywheel and engine block wherein a grommet unit conveys leads from the Hall effect device trigger assembly away from obstructions on the engine block.

As shown in FIG. 2A, lead wires 132 are guided from the housing 47. These wires connect to the PC board 65 having the Hall effect transducers associated therewith. In order to clear a top boss portion of the engine 130, an angled grommet 131 is provided. By use of this grommet, the wires readily clear obstructions on the engine.

Figure 2B:
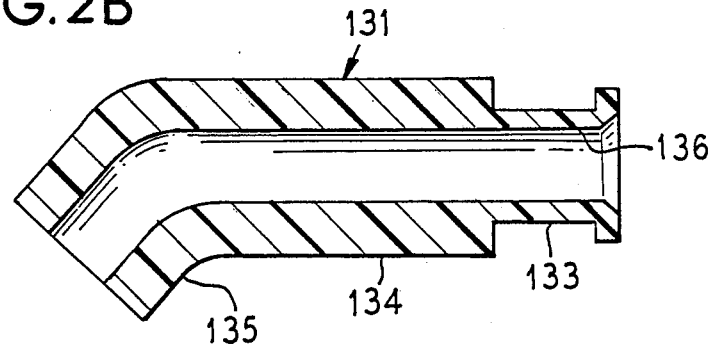
FIG. 2B is a cross-sectional view of the grommet shown in FIG. 2A.

FIG. 2B shows in cross-section the construction of the grommet 131. This grommet has an angled portion 135 which forms an angle of approximately 130° relative to a main body portion 134. A cut out ring-shaped portion 133 fits in an aperture of the housing 47 to retain the grommet there. A central passage 136 guides the wires through the grommet.

As shown in FIG. 3, the stator assembly 10 may, in one preferred embodiment, have a single power coil 55, two charge coils 56*a* and 56*b*, and four alternator coils 54*a, b, c,* and *d*. As can be seen in FIG. 3, additional pole legs are unused in this embodiment. However, if desired, to increase power capability, additional alternator coils, power coils, or charge coils can be provided.

As the flywheel rotates the magnets 53*a, b, c, d, e, f* past the end faces of the pole legs with the respective power, charge, and alternator coils thereon, voltages are generated in known fashion in the respective coils.

On the hub 26 of the flywheel or rotor 46, at an outer periphery thereof a magnet retainer 27 is provided as most clearly shown in FIG. 2. This magnet retainer supports a circular ceramic cylindrical magnet 28 together with an upper flux concentrator ring 29*b* and a lower flux concentrator ring 29*a*. The lower flux concentrator ring 29*a* has a partial side wall 7 which in the preferred embodiment shown here, extends approximately 180° as shown in FIG. 3. For the remaining 180°, it is not present. Rather, a corresponding side wall 6 extending down from the upper flux concentrator ring 29*b* is provided. These 180° side walls 6 or 7 thus alternately cover peripheral portions of the ring magnet 28 and respectively extend either from the top or the bottom of the ring magnet 28 at a periphery thereof. As discussed previously, the plastic bonded ferrite magnet of FIG. 3A may alternatively be employed.

The ignition timing housing 47 as shown in FIG. 2 contains the printed circuit board 65 for ignition timing circuitry and also contains a Hall device holder 66*a, b, c, d* at various locations around a circle as shown in FIG. 3. The Hall device holders 66*a, b, c, d* and circuit board 65 are impregnated in a potting compound 63 within the pocket 64 of the housing 47.

The bipolar Hall effect transducers 24*a, b, c, d* are mounted in the respective Hall device holders 66*a, b, c, d* and are positioned such that one surface of the transducer is directly adjacent to the flux concentrator ring side walls 6 or 7. A metal flux control rod 67*a, b, c, d* is positioned such that one end face is directly adjacent an opposite surface of the respective Hall effect transducers 24*a, b, c, d* and is also received within a respective aperture 2*a, b, c, d* of the Hall device holders 66*a, b, c, d*. These rods specifically locate the magnetic flux path onto the surface of the Hall effect transducers.

The Hall effect transducers 24*a, b, c, d* are received within respective pockets 68*a, b, c, d* of the Hall device holders 66*a, b, c, d*.

The metal rods 67*a, b, c, d* abut against the Hall device IC circuit outer wall so as to concentrate flux within a center of the integrated circuit of the Hall device.

As the flywheel or rotor 46 rotates, the transducers turn off and on in accordance with the flux concentrator ring outer walls 6 or 7 which are present. The flux concentrator ring 29*b* represents a north pole when the skirt 6 is present opposite the Hall effect transducer 24*a* as shown in FIG. 2. This turns off the Hall effect device. A south pole is represented by outer wall 7 as shown in the right-hand portion of FIG. 2. When this south pole is present, the Hall effect device 24*c* turns on.

By use of the sharp transitions between tee ends of the skirts or side walls 7 or 6 (or sharp transition regions 141*a, b* in FIG. 3A) in combination with the sharp or narrow path flux concentration resulting by use of the metal rods 67*a, b, c, d*, a very sharp turn-on and turn-off characteristic occurs in the Hall effect transducer, independently of motor RPM. Thus, even at very slow motor RPM, the turn-on and turn-off of the Hall effect transducers is sharp, and a sharp or well-defined waveform with steep leading and trailing edges results at the output of the Hall effect transducers. The output waveform is substantially uninfluenced by the RPM.

As shown in FIG. 3, electrolytic capacitor 70 may be mounted between Hall effect transducer 24*a* and 24*b* and a further electrolytic capacitor 71 may be mounted between Hall effect transducer 24*a* and 24*d* on the ignition timing housing 47. In the preferred embodiment of the invention, the metal flux concentrating rods 67*a, b, c, d* preferably have a diameter of approximately 0.06 inches.

The structure f the circuit block shown in FIG. 1 will now be described in greater detail by reference to FIGS. 4A, B, and 5.

Figure 4A:
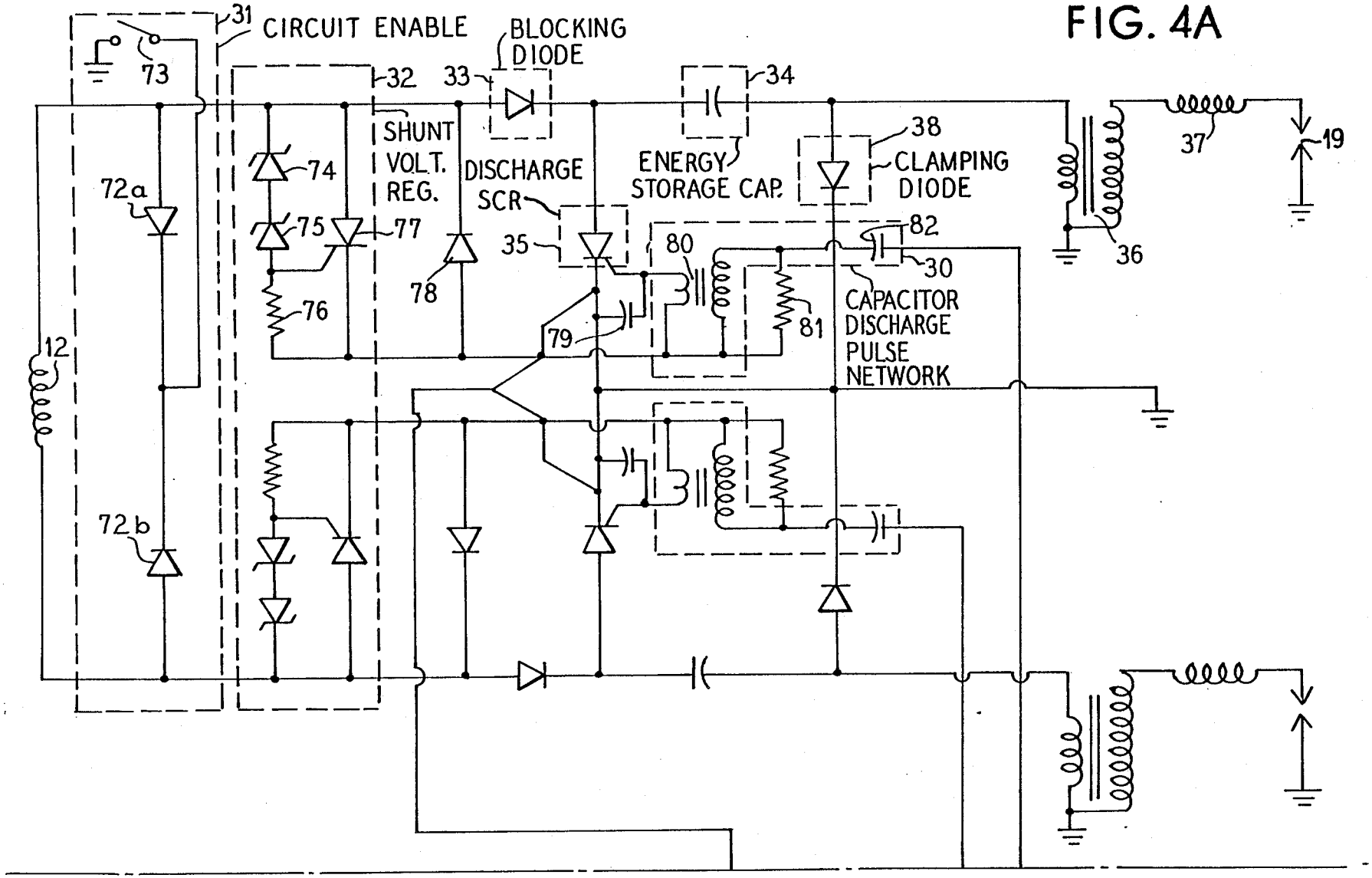
FIGS. 4A and 4B are, taken together, a detailed schematic diagram showing circuits fed by the charge coil and power coil, including the ignition timing circuit shown in the block diagram of FIG. 1.

As shown in FIG. 4A, at the output of charge coil 12 a circuit enable 31 is provided with a kill switch 73 for temporarily grounding outputs of the charge coil through diodes 72*a*, 72*b*. This results in no voltage to the ignition coil and thus no spark at the spark plugs 19, thus shutting off the engine.

The shunt voltage regulator 32 includes two identical sections formed of an SCR 77, series connected Zener diodes 74 and 75 connecting to the gate of the SCR 77, and bias resistor 76. A diode 78 is connected in parallel with the SCR 77. A blocking diode 33 connects voltage from the charge coil 12 through an energy storage capacitor 34 to the ignition coil 36. The capacitor discharge pulse network 30 controls a discharge SCR 35 connected between ground and one side of the energy storage capacitor 34. The gate of SCR 35 is controlled by the capacitor discharge pulse network 30 by current present at the secondary of transformer 80, which serves as a current amplifier. Capacitor 79 is provided in parallel with the gate of the SCR 35 and its cathode.

The primary of the current amplifying transformer 80 has a resistor 81 connected in parallel therewith, and a capacitor 82 is connected in series. The resistor 81, capacitor 82, and Hall device output form a control pulse for the primary of the transformer.

As shown in FIG. 4A, the other side of the charge coil also has a similar discharge SCR and capacitor discharge pulse network, and energy storage capacitor with associated blocking diode in mirror image fashion. The mirror image side of the circuit also supplies an ignition coil 36.

With the invention, the capacitor discharge pulse network 30 in FIG. 4A is controlled by the Hall effect device 24. When the Hall effect device 24 turns on, it discharges capacitor 82 into pulse transformer 80, so as to provide a turn-on pulse for discharge SCR 35. Upon complete discharge of energy storage capacitor 34, the SCR 35 again turns off. Without the capacitive discharge pulse network, the discharge SCR 35 will be on for a full 180°, corresponding to a full south pole of the trigger magnet. Thus, with the invention, less power is required to be output by the charge coil.

Figure 4B:
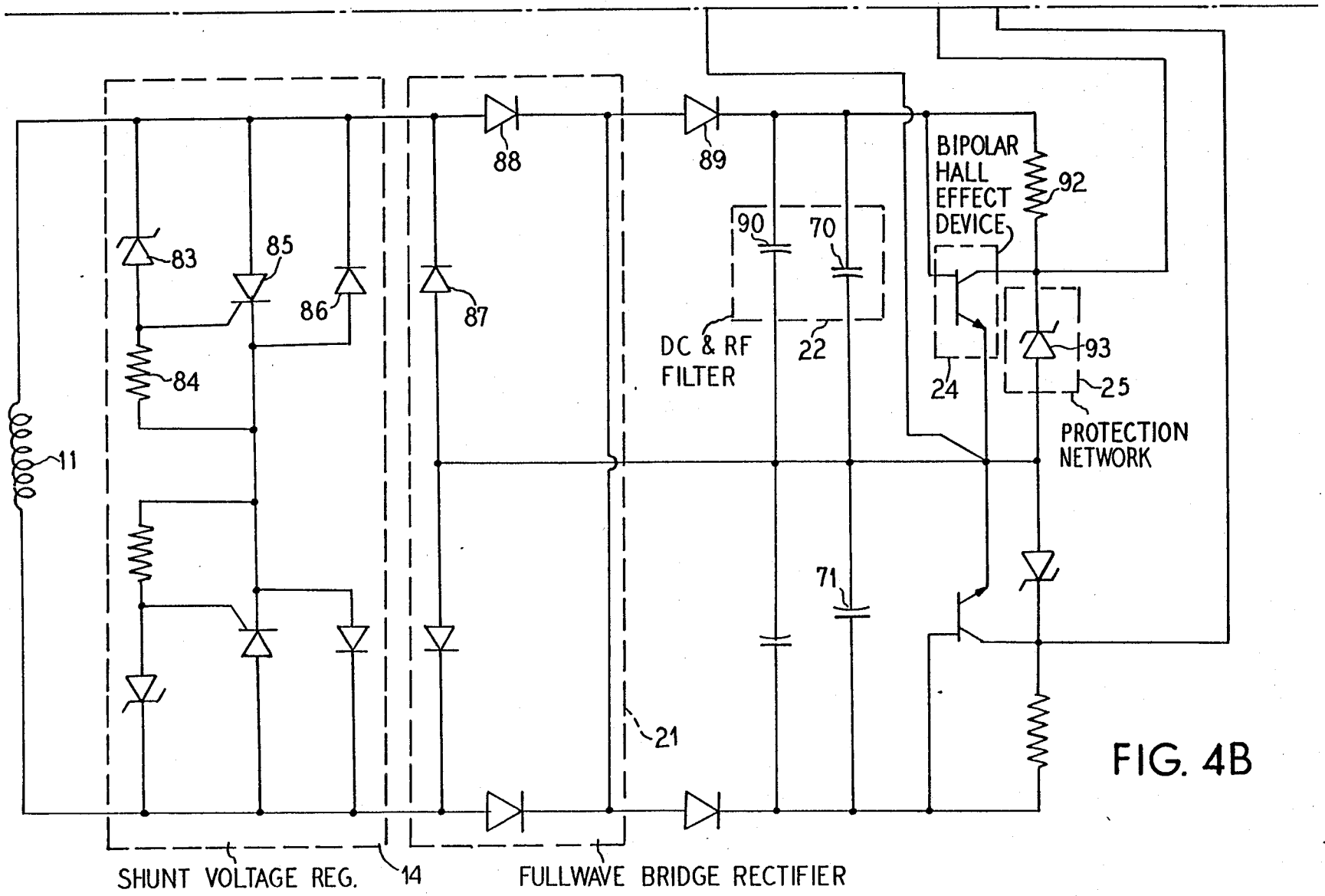

In FIG. 4B the power coil 11 is shown connecting with the shunt voltage regulator 14. The shunt voltage regulator 14 is formed of a mirror image circuit with one side being formed of a Zener 83, and resistor 84 controlling a gate of an SCR 85. A diode 86 connects across the SCR 85.

The output of the shunt voltage regulator 14 connects to a full wave bridge rectifier 21 formed of diodes 87 and 88 and the mirror image thereof. A steering diode 89 connects output voltage to the DC and RF filter 22 formed of a high frequency RF capacitor 90 and a low frequency electrolytic capacitor 70. Filtered power supply voltage is then fed to the bipolar Hall effect transducer 24. This transducer is an integrated circuit assembly provided by Microswitch, Inc., Honeywell Division, Freeport, Illinois as No. SS46. It includes a Hall effect device, trigger circuit, amplifier, voltage regulator, and Schmitt trigger. As previously explained, this Hall effect transducer is switched on and off by the aforementioned magnetic flux paths which are switched from north to south.

A resistor 92 bridges an output and input of the Hall effect transducer 24. The protection network 25 includes a Zener diode 93 connected across the output of the Hall effect transducer 24.

A mirror image of the circuit described above connects to the other side of the power coil.

The output of the Hall effect transducer 24 provides a switching voltage to the aforementioned capacitor pulse discharge network 30.

With the inventive circuit provided, the bipolar Hall effect device is off when a north pole is present at the device and is on with a south pole present. This results in a very efficient switching of the discharge SCR 35, independently of engine RPM.

With the invention, if the flywheel runs backwards, the engine won't start, unlike some prior art engines. This favorable result occurs since the bipolar Hall effect device will trigger the discharge SCRs 180° after top dead center when the pistons are at full downstroke.

Figure 5:
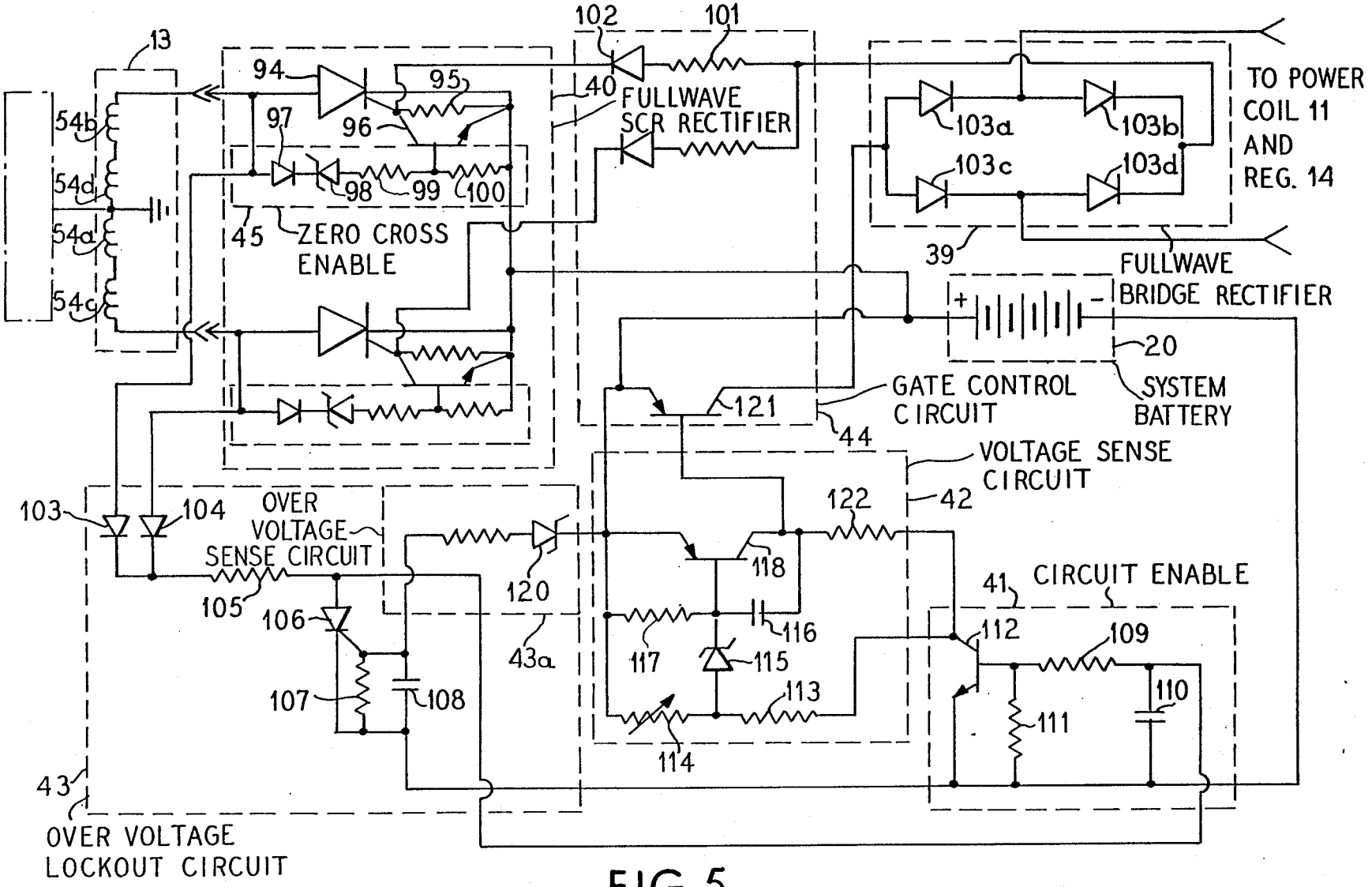
FIG. 5 is a detailed schematic diagram showing the circuits fed from the alternator coils and including the charging circuit and voltage regulating circuit shown in the block diagram of FIG. 1.

Referring now to FIG. 5, alternator coils 13 comprise individual stator coils 54*b* and 54*d* connected in series at one side, and alternator stator coils 54*a* and 54*c* connected in series at the other side. The series connected stator coils are connected at their output to respective full wave centertap SCR rectifier circuits 40. These circuits 40 comprise an SCR 94 whose gate is controlled by a transistor 96 having a resistor 95 in parallel with collector and emitter. A zero cross enable circuit 45 controls transistor 96. This zero cross enable circuit 45 includes a diode 97 connected in series with a Zener 98, resistor 99, and resistor 100.

The full wave center top SCR rectifier circuit 40 is also controlled by a gate control circuit 44 formed of a resistor 101 and diode 102 receiving voltage from the full wave bridge rectifier 39 formed of diodes 103*a*, 103*b*, 103*c*, and 103*d* connected to the power coil 11 and shunt voltage regulator 14.

The alternator coils 13 also feed an over-voltage lockout circuit 43 which includes diodes 103 and 104 connecting to resistor 105, which in turn connects to SCR 106. The gate of SCR 106 is controlled by resistor 107 and capacitor 108, and by an output from the over-voltage sense circuit 43*a*. An output of the over-voltage lockout circuit 43 connects to a circuit enable 41 at capacitor 110, resistor 109, and resistor 111. Transistor 112 of the circuit enable 41 has its output connected to control the voltage sense circuit 42. Voltage sense circuit 42 includes a transistor 118 whose gate is connected to a resistor 117 and capacitor 116, and also to a Zener diode 115. The Zener diode 115 at its anode has a voltage divider formed of variable resistor 114, and resistor 113. A bias resistor 122 connects to transistor 121.

The gate control circuit 44 includes a transistor 121 whose input connects to an output of the voltage sense circuit 42 and whose output at the emitter senses the voltage at the positive terminal of the 12-volt battery 20. The full wave bridge rectifier 39 supplies power to the collector of transistor 121 in the gate control circuit 44.

With the present invention, the zero cross enable circuit 45 turns on the full wave centertap SCR rectifier circuit 40 substantially only at the zero cross point of the SCR so as to prevent radio frequency interference.

If the engine is off, then the circuit enable 41 prevents battery current from being drained. The over-voltage lockout circuit 43 shuts down the charging circuit if there is a voltage sensing problem, or if the battery is accidentally disconnected from the circuit, such as the battery being thrown from the boat accidentally during maneuvering, or if the boat is hit by a wave or makes a sharp turn.

Operational Advantages of the Hall Effect Device Ignition and Charging System With the invention, a separate power coil is provided which generates a control voltage for the voltage regulator and Hall effect transducers. A traditional pick-up coil is not employed to provide a triggering voltage.

The present invention has the following advantages. The Hall effect transducer either sees a north or south magnetic flux and switches on or off virtually instantaneously. The flux change which triggers the Hall effect device occurs quickly and precisely in view of the aforementioned magnetic flux concentration apparatus, including the flux concentrator ring side walls or skirts 6 and 7 and the flux concentrator rods 67*a, b, c, d,* or the plastic bonded ferrite magnet system with narrow transition regions shown in FIG. 3*a.*

In view of the above, the Hall effect transducers produce a well-defined output waveform which has steep leading and trailing edges and which has a pulse totally independent of RPM. This is unlike the prior pickup coil which generated a broad wave shape, the profile of which changed with RPM. Thus, with the invention the timing is very precise and is virtually independent of RPM.

This allows the engine, and particularly a marine engine, to start at low RPM. Even at such low RPM, with the present invention the rapid flux change permits a high amplitude, well-defined signal to be generated by the trigger or timing circuits. This contrasts with the prior art wherein at low RPM the pickup coils would generate very little voltage since slow flux changes would result. Additionally, the shape of the output waveform from the pickup coils would change with RPM and would be quite broad at lower RPMs.

With the present invention, timing circuitry including the ignition timing circuit 17 and ignition voltage generating circuit 18, are only energized for a brief period—that is, only at the time ignition is required at the ignition coil. Accordingly, there is less drain on the charge coils and a fewer number of charge coils are required. This results in less expense and loading.

With the invention, timing can be set very precisely in view of the design shape of the plastic bonded ferrite magnet, or flux concentrator rings 29*a* and *b* and their associated side walls or skirts 6 and 7. Also, the provision of the flux concentrator rod 67*a, b, c, d* can be precisely adjusted relative to a center of the Hall effect transducer circuit so that a very high flux density at a very precise location can be provided for influencing the Hall effect device within the Hall effect transducer. Thus, the system can have high sensitivity coupled with ease and stability of timing adjustments.

With the invention, the discharge SCR 35 can be precisely controlled with a discharge pulse transformer 80. The precise control of the discharge SCR 35, which in turn control the energy storage capacitor 34, results in high efficiency and switching of current to the ignition coil primary.

Also with the invention, as previously explained less power is required to be output by the charge coil.

Although various minor changes and modifications might be proposed by those skilled in the art, it will be understood that I wish to include within the claims of the patent warranted hereon all such changes and modifications as reasonably come within my contribution to the art.

I claim as my Invention:

1. An engine ignition system, comprising:

a rotor having at least one magnet, and also having magnetic timing means for generating a flux path which rotates with the rotor but at a predetermined location relative to the rotor;

a stator having poles with at least one charge coil on one pole and at least one power coil separate from the charge coil on another pole, the stator being positioned relative to the rotor such that as the rotor rotates, the at least one magnet will pass in close proximity to the stator poles;

a bipolar Hall effect transducer means positioned in proximity to said magnetic timing means so that as the flux path passes the Hall effect transducer means as the rotor rotates a trigger pulse is generated;

power supply means connected to the power coil to supply power to the Hall effect transducer means;

engine ignition means for igniting fuel used in the engine; and an ignition voltage generating means having a first input connected to the charge coil, an output connected to the engine ignition means for supplying an ignition voltage thereto, and a second input connected to receive said trigger pulse from the Hall effect transducer means, said ignition voltage generating means producing said ignition voltage in timed relation with a rotary position of the rotor relative to the stator through sensing of said flux path generated by the magnetic timing means.

2. A system according to claim 1 wherein said magnetic timing means comprises a magnetic flux switching means on the rotor adjacent the Hall effect transducer means for selectively changing a flux polarity as the rotor rotates relative to the Hall effect transducer means.

3. The system according to claim 2 wherein the magnetic flux switching means comprises upper and lower flux concentrator rings at upper and lower faces of a concentric magnet and wherein said flux concentrator rings have side walls extending around a given angle of a periphery of the magnet.

4. The system according to claim 1 wherein said bipolar Hall effect transducer means is part of an ignition timing circuit having a pulse generating means for controlling a switching device in said ignition voltage generating means.

5. The system according to claim 4 wherein said ignition voltage generating means includes an energy storage capacitor connected to said switching device for periodically discharging energy stored in the capacitor, an ignition coil being provided for receiving energy in accordance with said switching device, and means for connecting a high voltage output from the ignition coil to a spark plug serving as said engine ignition means.

6. An engine ignition system, comprising:

a rotor having at least one magnet, and also having magnetic timing means for generating a flux path which rotates with the rotor but at a predetermined location relative to the rotor;

a stator having poles with at least one charge coil and at least one power coil on the poles, the stator being positioned relative to the rotor such that as the rotor rotates, the at least one magnet will pass in close proximity to the stator poles;

a bipolar Hall effect transducer means positioned in proximity to said magnetic timing means so that as the flux path passes the Hall effect transducer means as the rotor rotates a trigger pulse is generated;

power supply means connected to the power coil to supply power to the Hall effect transducer means;

engine ignition means for igniting fuel used in the engine;

an ignition voltage generating means having a first input connected to the charge coil, an output connected to the engine ignition means for supplying an ignition voltage thereto, and a second input connected to receive said trigger pulse from the Hall effect transducer means, said ignition voltage generating means producing said ignition voltage in timed relation with a rotary position of the rotor relative to the stator through sensing of said flux path generated by the magnetic timing means; and a flux concentrator means being positioned in fixed relation to the Hall effect transducer means for precisely positioning a concentrated flux path relative to the Hall effect transducer means.

7. The system according to claim 6 wherein the flux concentrator means comprises a rod, one end of which is positioned directly adjacent the Hall effect transducer means.

8. An engine ignition system, comprising:

a rotor having at least one magnet, and also having magnetic timing means for generating a flux path which rotates with the rotor but at a predetermined location relative to the rotor;

a stator having poles with at least one charge coil and at least one power coil on the poles, the stator being positioned relative to the rotor such that as the rotor rotates, the at least one magnet will pass in close proximity to the stator poles;

a bipolar Hall effect transducer means positioned in proximity to said magnetic timing means so that as the flux path passes the Hall effect transducer means as the rotor rotates a trigger pulse is generated;

power supply means connected to the power coil to supply power to the Hall effect transducer means;

engine ignition means for igniting fuel used in the engine;

an ignition voltage generating means having a first input connected to the charge coil, an output connected to the engine ignition means for supplying an ignition voltage thereto, and a second input connected to receive said trigger pulse from the Hall effect transducer means, said ignition voltage generating means producing said ignition voltage in timed relation with a rotary position of the rotor relative to the stator through sensing of said flux path generated by the magnetic timing means; and a plurality of magnets being provided in a circular pattern on the rotor.

9. The system according to claim 8 wherein said neutral section has a width less than 0.045 inches.

10. The system according to claim 8, wherein said neutral section width is less than 0.03 inches.

11. An engine ignition system, comprising:

a rotor having at least one magnet, and also having magnetic timing means for generating a flux path which rotates with the rotor but at a predetermined location relative to the rotor;

a stator having poles with at least one charge coil and at least one power coil on the poles, the stator being positioned relative to the rotor such that as the rotor rotates, the at least one magnet will pass in close proximity to the stator poles;

a bipolar Hall effect transducer means positioned in proximity to said magnetic timing means so that as the flux path passes the Hall effect transducer means as the rotor rotates a trigger pulse is generated;

power supply means connected to the power coil to supply power to the Hall effect transducer means;

engine ignition means for igniting fuel used in the engine;

an ignition voltage generating means having a first input connected to the charge coil, an output connected to the engine ignition means for supplying an ignition voltage thereto, and a second input connected to receive said trigger pulse from the Hall effect transducer means, said ignition voltage generating means producing said ignition voltage in timed relation with a rotary position of the rotor relative to the stator through sensing of said flux path generated by the magnetic timing means; and a plurality of magnets being provided in a circular pattern on the rotor.

12. The system according to claim 11 wherein the stator also has at least one alternator coil, said alternator coil connecting to a charging circuit means connecting to a system battery, said charging circuit means providing voltage to charge the battery.

13. The system according to claim 12 wherein said charging circuit means is controlled by a voltage regulating means for sensing system battery voltage and generating an appropriate control signal for the charging circuit means.

14. The system according to claim 13 wherein the power coil connects through a charging circuit power supply to provide power to the voltage regulating circuit means.

15. An engine ignition system, comprising:

a rotor having at last one magnet, and also having magnetic timing means for generating a flux path which rotates with the rotor but at a predetermined location relative to the rotor;

a stator having poles with at least on charge coil and at least one power coil on the poles, the stator being positioned relative to the rotor such that as the rotor rotates, the at least one magnet will pass in close proximity to the stator poles;

a bipolar Hall effect transducer means positioned in proximity to said magnetic timing means so that as the flux path passes the Hall effect transducer means as the rotor rotates a trigger pulse is generated;

power supply means connected to the power coil to supply power to the Hall effect transducer means;

engine ignition means for igniting fuel used in the engine;

an ignition voltage generating means having a first input connected to the charge coil, an output connected to the engine ignition means for supplying an ignition voltage thereto, and a second input connected to receive said trigger pulse from the Hall effect transducer means, said ignition voltage generating means producing said ignition voltage in timed relation with a rotary position of the rotor relative to the stator through sensing of said flux path generated by the magnetic timing means; and said stator also including alternator coils connected to feed voltage to a switching device which in turn connects to a system battery, and wherein a voltage regulating means controls said switching device, said voltage regulating means including a voltage sense circuit connected to the system battery and also connected to control a gate control circuit connected to said switching device.

16. The system according to claim 15 wherein another voltage sense circuit is provided connected to said system battery, and wherein an over-voltage lockout circuit is controlled from an output of said another voltage sense circuit, and which in turn controls a circuit enable whose output connects to the voltage sense circuit.

17. An engine ignition system, comprising:

a rotor having at least one magnet, and also having magnetic timing means for generating a flux path which rotates with the rotor but at a predetermined location relative to the rotor;

a stator having poles with at least one charge coil and at least one power coil on the poles, the stator being positioned relative to the rotor such that as the rotor rotates, the at least one magnet will pass in close proximity to the stator poles;

a bipolar Hall effect transducer means positioned in proximity to said magnetic timing means so that as the flux path passes the Hall effect transducer means as the rotor rotates a trigger pulse is generated;

power supply means connected to the power coil to supply power to the Hall effect transducer means;

engine ignition means for igniting fuel used in the engine;

an ignition voltage generating means having a first input connected to the charge coil, an output connected to the engine ignition means for supplying an ignition voltage thereto, and a second input connected to receive said trigger pulse from the Hall effect transducer means, said ignition voltage generating means producing said ignition voltage in timed relation with a rotary position of the rotor relative to the stator through sensing of said flux path generated by the magnetic timing means; and the Hall effect transducer means being received in a trigger housing having an aperture therein through which a shaft passes which is connected to said rotor.

18. The system according to claim 17 wherein the housing has means associated therewith for selectively fixing a position thereof for adjusting timing of the system by rotation of the housing relative to the stator.

19. A system according to claim 18 wherein a bearing cage having an aperture therein for supporting said shaft is provided, and said housing rests on said bearing cage, and wherein said bearing cage has support means for said stator.

20. An engine ignition and charging system, comprising:

a rotor having at least one magnet, and also having magnetic timing means for generating a timing flux path at a predetermined location relative to the rotor;

a stator having at least one charge coil, one alternator coil, and at least one power coil independent and separate from alternator and power coils on the stator, the stator being positioned relative to the rotor such that as the rotor rotates, the at least one magnet will pass in close proximity to the coils;

charging means connecting an output of the alternator coil to a system battery;

a Hall effect transducer means positioned in proximity to said magnetic timing means so as to sense passage of the timing flux path and generate a trigger voltage;

power supply means connected to the power coil to supply power to the Hall effect transducer means;

engine ignition means for igniting fuel used in the engine; and an ignition voltage generating means having a first input connected to the charge coil, an output connected to the engine ignition means for supplying an ignition voltage thereto, and a second input connected to receive said trigger voltage from the Hall effect transducer means, said ignition voltage generating means producing said ignition voltage in timed relation with a rotary position of the rotor relative to the stator through sensing of said flux path.

21. An engine ignition timing system, comprising:

a rotating member having magnetic timing means attached to and rotating with the rotating member for generating a flux path at a predetermined location relative to the rotating member;

the rotating member being a shaft having a rotor, and wherein a stator is positioned adjacent the rotor, the rotor has at least one magnet, the stator has at least one power coil independent of any charge coils or alternator coils on the stator such that as the rotor rotates, the at least one magnet will pass in close proximity to the power coil, and wherein means connects an output of the power coil to supply operating voltage to a Hall effect transducer means;

said Hall effect transducer means being positioned in proximity to said magnetic timing means on the rotating member so that as the flux path passes the Hall effect transducer means, a trigger pulse is generated; and ignition voltage generating means for supplying an ignition voltage timed in accordance with said trigger pulse from the Hall effect transducer means.

22. A system according to claim 21 wherein the rotating member is a shaft having a rotor, and wherein a stator is positioned adjacent the rotor, the rotor has at least one magnet, the stator has at least one power coil such that as the rotor rotates, the at last on magnet will pass in close proximity to the power coil, and wherein means connects an output of the power coil to supply operating voltage to said Hall effect transducer means.

23. A system according to claim 22 wherein the stator also has a charge coil connected to feed voltage to said ignition voltage generating means.

24. An engine ignition timing system, comprising:

a rotating member having magnetic timing means attached to and rotating with the rotating member for generating a flux path at a predetermined location relative to the rotating member;

a Hall effect transducer means positioned in proximity to said magnetic timing means on the rotating member so that as the flux path passes the Hall effect transducer means, a trigger pulse is generated;

ignition voltage generating means for supplying an ignition voltage timed in accordance with said trigger pulse from the Hall effect transducer means;

the rotating member being a shaft having a rotor, and wherein a stator is positioned adjacent the rotor, the rotor having at least one magnet, the stator having at least one power coil such that as the rotor rotates, the at least one magnet will pass in close proximity to the power coil, and wherein means are provided for connecting an output of the power coil to supply operating voltage to said Hall effect transducer means;

the stator also having a charge coil connected to feed voltage to said ignition voltage generating means; and said ignition voltage generating means including a discharge SCR connected for feeding energy from an energy storage capacitor to an ignition coil, and wherein said Hall effect transducer means connects through a capacitive discharge pulse network means to said discharge SCR for selectively controlling said discharge SCR on-time duration, said capacitor discharge pulse network means limiting on-time duration of the discharge SCR so as to limit power consumed by the charge coil.

25. An engine ignition timing system, comprising:

a rotating member having magnetic timing means attached to and rotating with the rotating member for generating a flux path at a predetermined location relative to the rotating member;

a Hall effect transducer means positioned in proximity to said magnetic timing means on the rotating member so that as the flux path passes the Hall effect transducer means, a trigger pulse is generated;

ignition voltage generating means for supplying an ignition voltage timed in accordance with said trigger pulse from the Hall effect transducer means;

the rotating member being a shaft having a rotor, and wherein a stator is positioned adjacent the rotor, the rotor has at least one magnet, the stator has at least one power coil such that as the rotor rotates, the at least one magnet will pass in close proximity to the power coil, and wherein means are provided for connecting an output of the power coil to supply operating voltage to said Hall effect transducer means; and said shaft being a motor crank shaft, and wherein the Hall effect transducer means is provided in a trigger housing and leads are provided extending from said trigger housing, and grommet means being provided for guiding said leads at an angle relative to said trigger housing in a range from 100° to 140° relative to a perpendicular central axis of a said shaft so as to clear a top portion of said motor.

26. An engine ignition timing system, comprising:

a rotating member having magnetic timing means attached to and rotating with the rotating member for generating a flux path at a predetermined location relative to the rotating member;

a Hall effect transducer means positioned in proximity to said magnetic timing means on the rotating member so that as the flux path passes the Hall effect transducer means, a trigger pulse is generated;

ignition voltage generating means for supplying an ignition voltage timed in accordance with said trigger pulse from the Hall effect transducer means; and said magnetic timing means comprising a ring magnet having a north pole portion, a south pole portion, and a neutral zone.

27. A system according to claim 26 wherein said neutral zone has a width less than 0.045 inches.

28. A system according to claim 26 wherein said neutral zone has a width less than 0.03 inches.

29. An engine ignition timing system, comprising:

a rotor having a ring magnet and means for defining a transition region between opposite poles rotating with the rotor for generating a flux path at a predetermined location relative to the rotor;

a stator associated with the rotor having a power coil;

a Hall effect transducer means connected to receive power from the power coil and positioned in proximity to said magnetic timing means on the rotor so that as the flux path passes the Hall effect transducer means, a trigger pulse is generated;

ignition voltage generating means for supplying an ignition voltage timed in accordance with said trigger pulse from the Hall effect transducer means; and said power coil being independent of any charging or alternator coils on the stator.

* * * * *